US005086725A

United States Patent [19]

Garrett et al.

[11] Patent Number: 5,086,725

[45] Date of Patent: Feb. 11, 1992

[54] UNITIZED RECREATIONAL BOAT CONSTRUCTION

[75] Inventors: Paul D. Garrett, Merritt Island; Michael R. Meyer, Cocoa; Danny T. York, Rockledge, all of Fla.

[73] Assignee: Brunswick Corporation, Skokie, Ill.

[21] Appl. No.: 533,509

[22] Filed: Jun. 5, 1990

[51] Int. Cl.[5] ..... B63B 3/09

[52] U.S. Cl. ..... 114/356; 114/355; 114/357; 114/61

[58] Field of Search ..... 114/343, 355–357, 114/271, 292, 61, 88, 85, 352, 65 R

[56] References Cited

U.S. PATENT DOCUMENTS

| | | | |
|---|---|---|---|
| 3,085,262 | 4/1963 | Plemmons | 114/352 |
| 3,134,113 | 5/1964 | Boyington | 114/356 |
| 3,871,043 | 3/1975 | Davidson | 114/88 |
| 4,060,865 | 12/1977 | Woolworth | 114/356 |
| 4,517,911 | 5/1985 | Seefeld | 114/356 |
| 4,870,919 | 10/1989 | Allison | 114/61 |
| 4,892,054 | 1/1990 | Davidson | 114/357 |
| 4,895,095 | 1/1990 | Potter | 114/357 |
| 4,917,037 | 4/1990 | Hargett | 114/356 |

*Primary Examiner*—Joseph F. Peters, Jr.
*Assistant Examiner*—Clifford T. Bartz
*Attorney, Agent, or Firm*—Duckworth, Allen, Dyer & Doppelt

[57] ABSTRACT

A recreational boat construction utilizes a hull formed of a thin gauge metal, such as aluminum, with the hull having an upper extremity to which are fastened unitary superstructure members molded from a plastic resin. The superstructure panels are rigidly fastened to the upper extremity of the hull and to the deck.

1 Claim, 7 Drawing Sheets

UNITIZED RECREATIONAL BOAT CONSTRUCTION

FIELD OF THE INVENTION

The present invention relates generally to boats, and in particular relates to recreational motor boats employing a metal hull, such as aluminum, and a superstructure of a diverse material, such as a molded resin.

DESCRIPTION OF THE PRIOR ART

The term "recreational motorboat" includes boats used for a variety of purposes, including fishing, water skiing and cruising. Fiberglass and aluminum have now largely replaced wood as construction materials for recreational boats. Generally, however, either aluminum or fiberglass is used exclusively for a specific boat design. For example, recreational boats fabricated with fiberglass usually employ a molded fiberglass hull and superstructure, while occasionally using aluminum or wood trim. By the same token, aluminum boats usually employ a unitary construction almost entirely of aluminum, with plastic or wooden trim.

Recreational pontoon boats are usually characterized by a pair of pontoons with a flat deck, and with a superstructure mounted upon the deck. In recent years, the market for motorized recreational pontoon boats has been dominated by boats employing aluminum pontoons formed in a cylindrical configuration, and with a superstructure of aluminum railing having fiberglass or plastic paneling. Typically, these boats are not designed to operate at planing speeds, and tend to suffer from rattle noise vibrations along the aluminum tubing and fiberglass paneling that form the superstructure. Further, when operated at higher speeds, thin gauge aluminum pontoons of the type used in the prior art tend to experience flexure along the longitudinal direction.

SUMMARY OF THE INVENTION

The present invention comprises a construction for a recreational boat having a hull formed of a thin-gauge metal, such as aluminum. The hull includes an upper extremity to which is rigidly attached a vertical superstructure of a plurality of vertically extending members, each of which are molded from a plastic resin into a continuous, unitary panel. The panels may be fastened with screws or other fasteners along the periphery of the hull, so that a rigid construction of the metal hull and the plurality of molded superstructure panels is established. Suitably, the superstructure panels are formed of a molded fiberglass and resin combination. The construction is particularly suitable for use with a pontoon boat having high performance planing pontoons. In one embodiment, each pontoon includes an upper extremity extending to, and overlapping the outer periphery of the deck. The superstructure panels include a longitudinal flange which overlies the upper extremity of the hull, with the fasteners thus extending through all of the panels, the hull upper extremity and the deck to establish the desired rigid construction.

DETAILED DESCRIPTION

Figure 1:
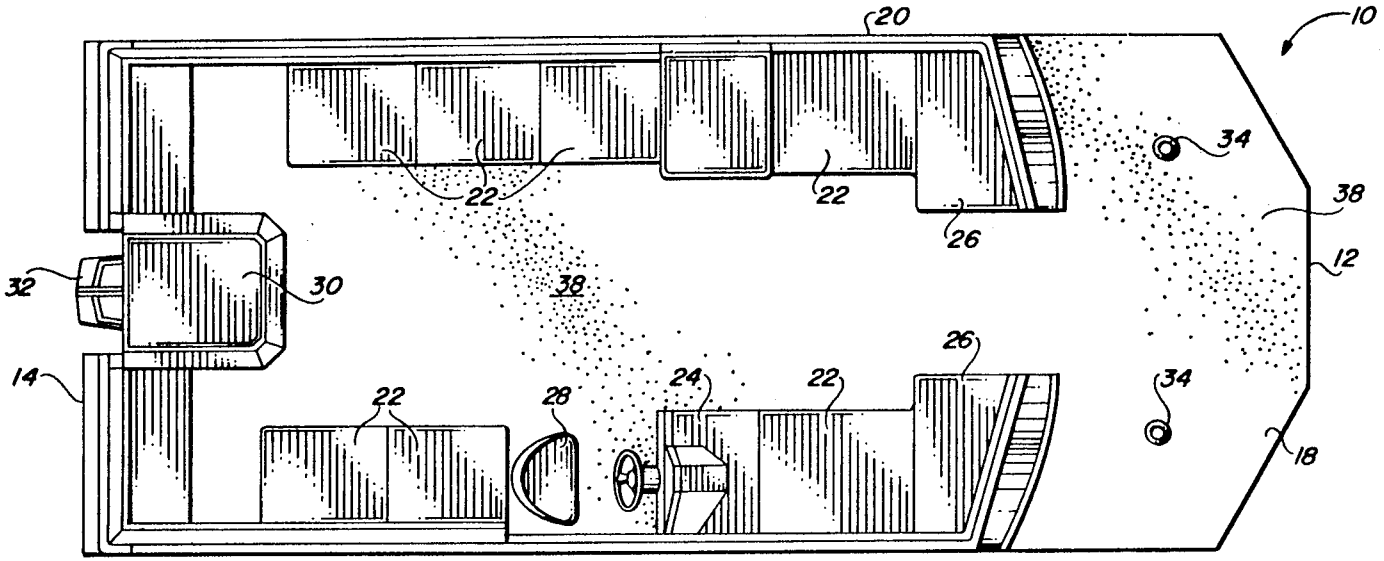

A planing pontoon boat in accordance with the present invention is shown in FIGS 1–4 and referred to generally with the reference numeral 10. The boat 10 includes a bow 12 and stern 14, and a pair of pontoons 16, 17, the pontoons being configured for planing in a manner described in greater detail below with reference to FIGS. 6 and 7, together with FIGS. 8-16. It will be understood that the pontoons 16, 17 extend longitudinally from bow to stern in the general direction of boat travel, depicted by the arrow adjacent the bow in FIGS. 1 and 2.

The pontoon boat 10 includes a deck 18 and a plurality of vertical superstructure members 20 which are rigidly joined with both the deck and the pontoons 16. 5–16. The boat 10 further includes a plurality of molded seat supports 22, a molded helm 24, and molded forward panels 26, each of which are formed of a unitary construction in accordance with the present invention. The details of the manner in which the vertical superstructure panels 20 are joined together with the deck 18 and the pontoon 16 will be described in greater detail below with reference to FIGS. 17–19. A helmsman seat 28 is mounted aft of the helm 24. A motor cover 30 extends over a conventional outboard motor 32, with the motor 32 extending into a motor well, the details of which are described below with reference to FIG. 20.

The boat 10 further includes a pair of fishing seat mounts 34 across the bow (FIGS. 1 and 2) for fishing seats 35 (FIG. 3), and the deck 18 may include carpeting 38 across the upper surface. Further details of the construction of the deck and pontoons of the boat 10 are described next with reference to FIG. 5, where a portion of the deck 18 is cut away in order to illustrate most of the interior of the one of the pontoons 16, and a portion of the interior of the other pontoon 17.

Figure 5:
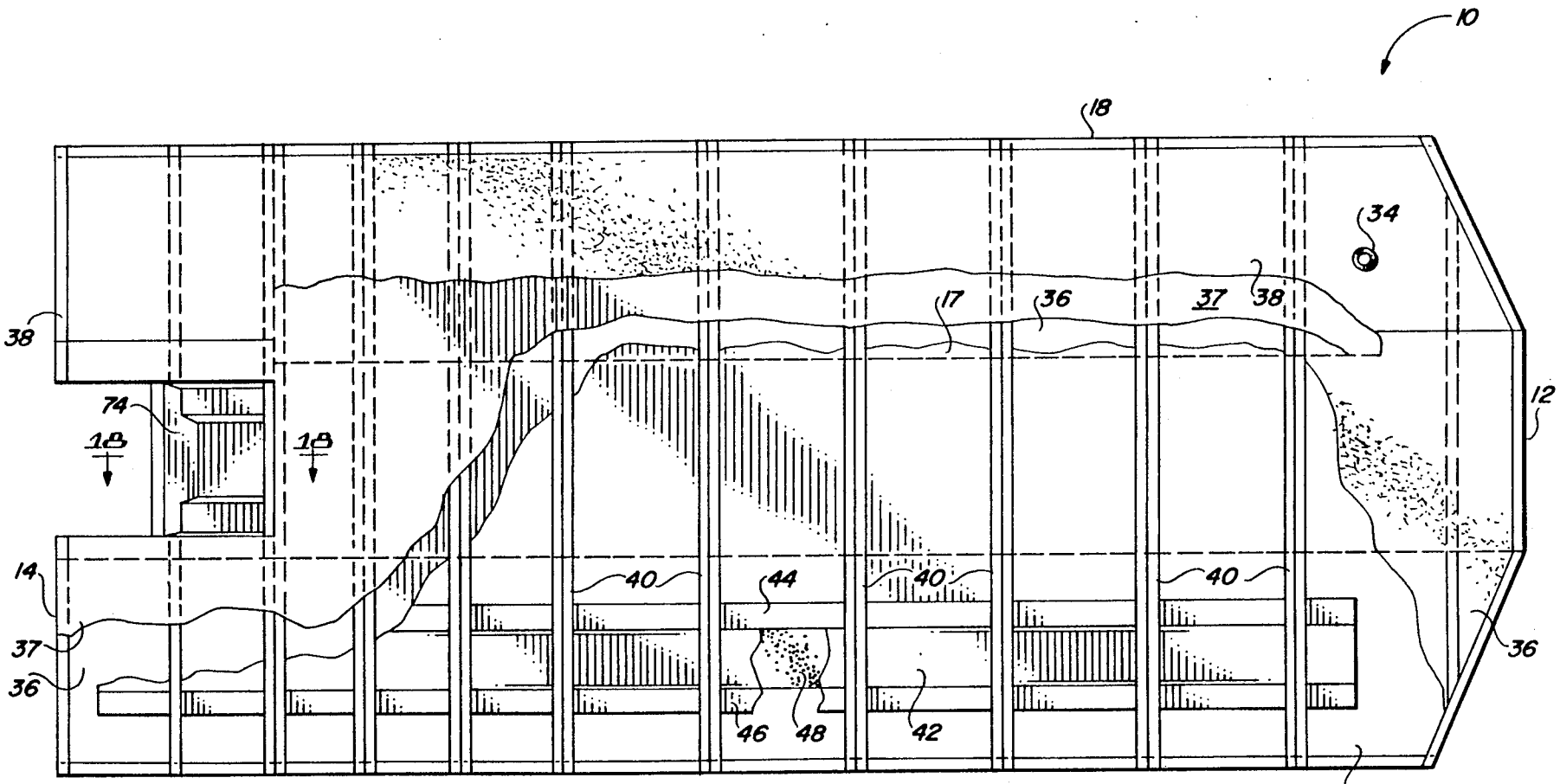
FIG. 5 is a top plan view, partially cut away, illustrating one embodiment of the pontoon boat of the present invention with the superstructure removed, and with a portion of the deck construction broken away, and another portion illustrated in dotted lines.
Figure 22:
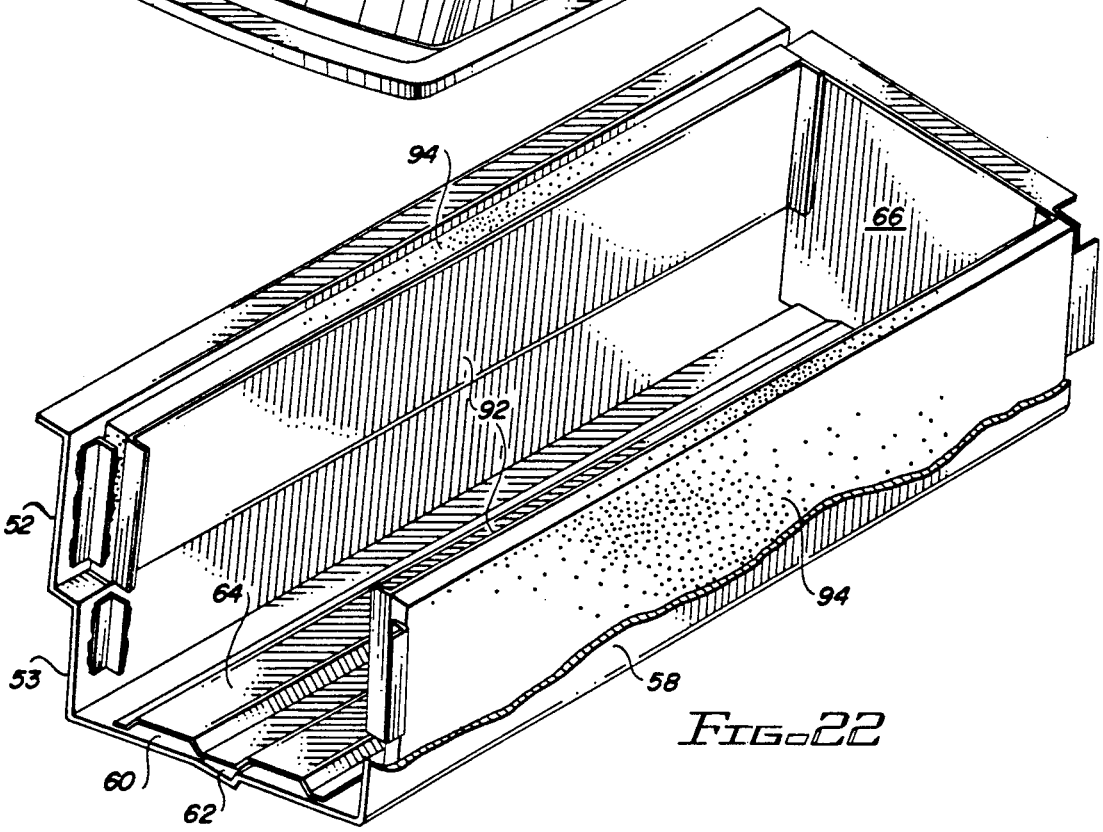
FIG. 22 illustrates construction details of one embodiment of a planing pontoon manufactured for a pontoon boat in accordance with the present invention.

As shown in FIG. 5, the deck 18 comprises a lower deck that extends across both of the pontoons 16, 17 and across which are supported lateral struts 40. An upper deck 37 is supported by the struts 40 and the carpet 38 extends across the upper deck 37. A longitudinal stringer 42 is provided extending longitudinally along substantially the length of the pontoon 16, the stringer 42 having opposing spaced flat surface portions 44, 46 lying flush with the inside surface of the bottom of the pontoon 16, with another wall portion between portion 44, 46 and forming an inverted "U" configuration. In accordance with the present invention, the void created by the U-shaped configuration of the stringer is filled with a buoyant foam 48 along substantially the entire length of the stringer. As illustrated in FIG. 22, the stringer may also assume an inverted "W" configuration. In order to conform the stringer 42 with the curved shape of the pontoon 16, plural lateral relief slots 43 are formed in the stringer.

Figure 6:
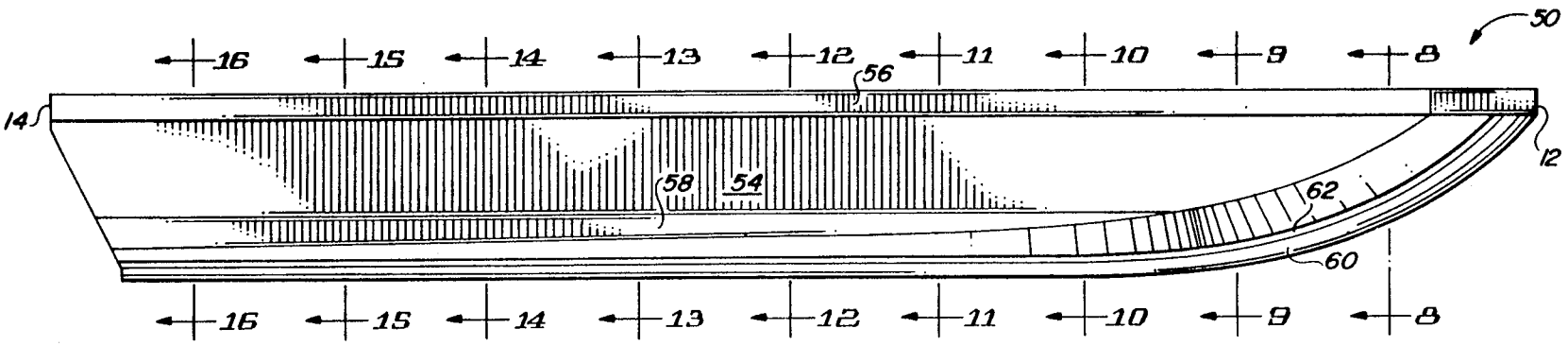
FIGS. 6 and 7 are side elevation and top plan views, respectively, of one embodiment of a pontoon useful for a pontoon boat in accordance with the present invention.
Figure 7:
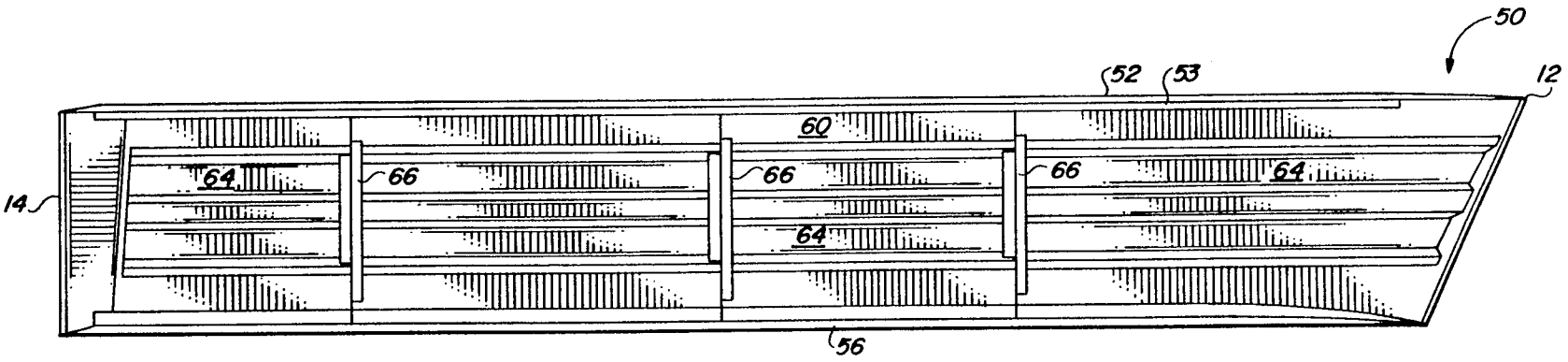
Figures 8, 9, 10, 11, 12, 13, 14, 15, 16:
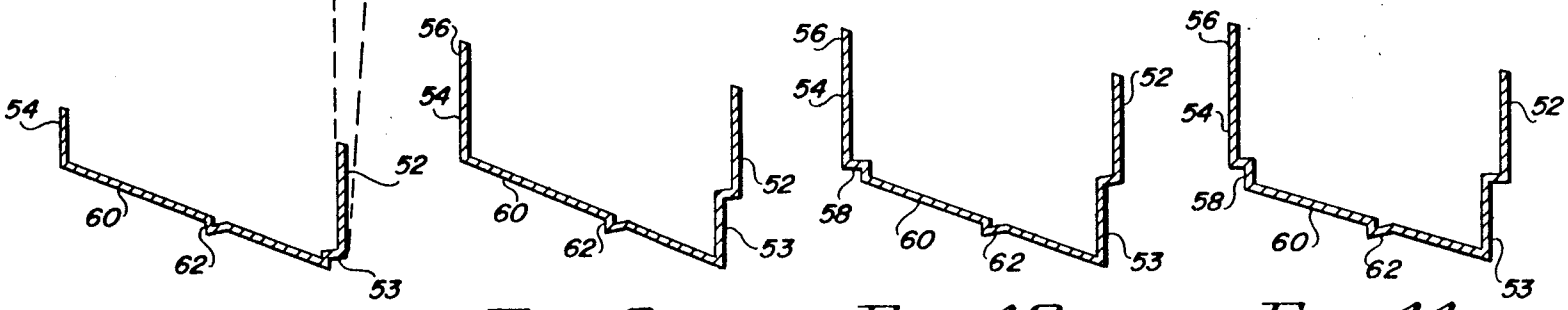
FIGS. 8–16 are cross-sectional views of the pontoon shown in FIGS. 6 and 7, taken along the respective cross-section lines 6—6′ through 14—14′.

Construction details of a pontoon in accordance with the present invention will now be described with reference to FIGS. 6–16. In FIGS. 6 and 7, the pontoon is referred generally by the reference numeral 50, and has a construction essentially identical to the pontoons 16, 17 of FIGS. 1–5.

Now noting FIGS. 6 and 7, the pontoon 50 is preferably fabricated of thin gauge aluminum with a vertical panel 52 forming the inside wall of the pontoon 50 and with the vertical wall defining a strake near its lower extremity which decreases from stern to bow, as is shown in FIGS. 8-16 by the indented portion 53. Likewise, the pontoon 50 includes an outside, generally vertical panel 54 defining a strake along its length which diminishes gradually from bow to stern as is defined by the indented portion 58 along the outer vertical surface 54. As is shown in FIGS. 8–16, the strakes along each of the vertical panels, 52, 54 are generally coextensive, with the strake for the outside surface 54 terminating aft of the termination point of the strake along the inside surface 52, because of the upward and increasing angular rake of the bottom surface 60. The outer vertical panel 54 also includes an upper extension 56 which extends beyond the vertical extremity of the inside vertical panel 52, in order to effectuate a unitary construction described below with reference to FIGS. 17–19). In accordance with the present invention, the inside vertical panel 52 (including indented portion 53) is canted at an outward angle, which angle is illustrated using the Greek letter "theta" in FIG. 8. This angle is typically between two to ten degrees, depending upon the optimum speed of the pontoon boat.

For example, pontoon boats designed to operate at faster optimum speeds are provided with an angle along the vertical panel 52 on the order of two to five degrees, while pontoon boats design to operate at lower optimum speeds are fabricated with an angle along the vertical panel on the order to five to ten degrees. The greater the angle, the greater the amount of water that rises vertically along the vertical panel 52 during turning maneuvers. It will thus be understood that the vertical panel 52 is not completely "vertical" but forms an angle slightly less than 90 degrees with the underside of the deck.

The pontoon 50 further includes a bottom panel 60 having a longitudinal strake 62 along its outside surface, the bottom panel 60 angled upwardly and outwardly from the inner vertical panel 50 to the outer vertical panel 54. Further in accordance with the present invention, the angularity of the bottom panel 60 increases from the stern 14 to the bow 12, intersects the outside vertical panel 54 at the extremity of the sponson along that surface (Note FIGS. 9 and 10), and then rises to the level of the lower deck 36 at the bow !2 (note FIG. 8).

Figure 2:
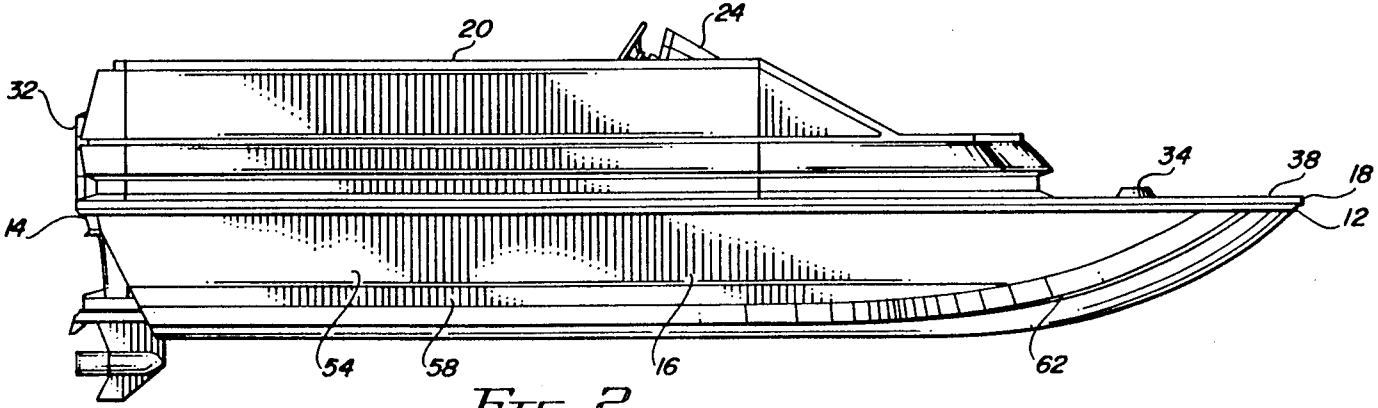
FIGS. 2 are top plan and side elevations, respectively, of an embodiment of a pontoon boat in accordance with the present invention.

It will of course be understood that the pontoon boat 10 of FIGS. 1 and 2 includes an opposing pontoon (i.e, pontoon 17 in FIGS. 3 and 4) which is a mirror image of the pontoon shown in FIGS. 6–16, such that the pontoons provide planing surfaces for the pontoon boat 10 when operated at the designed optimum speeds.

Noting FIG. 7, to provide structural strength to the pontoon 50, a longitudinal stringer 64 is provided which serves the same function as the longitudinal stringer 42 of FIG. 5, except that the stringer 64 assumes an inverted "W" configuration and is not provided with buoyant foam inside its length. (The stringer 64 is omitted in FIGS. 6–16 for clarity.) In this alternative form, the buoyant flotation foam is provided along the side panels of the pontoon, as is described in greater detail below with reference to FIG. 22. The pontoon further includes a plurality of bulkheads 66 spaced along the length of the pontoon for providing lateral structural strength.

Figure 17:
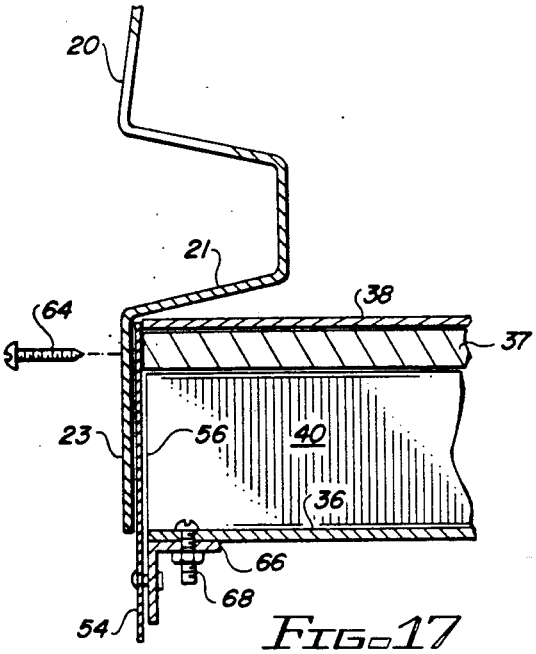
FIGS. 17 and 18 are cross-sectional views.
Figure 18:
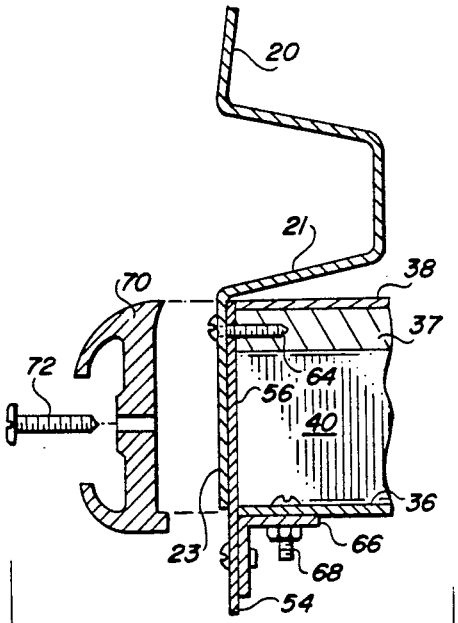
Figure 19:
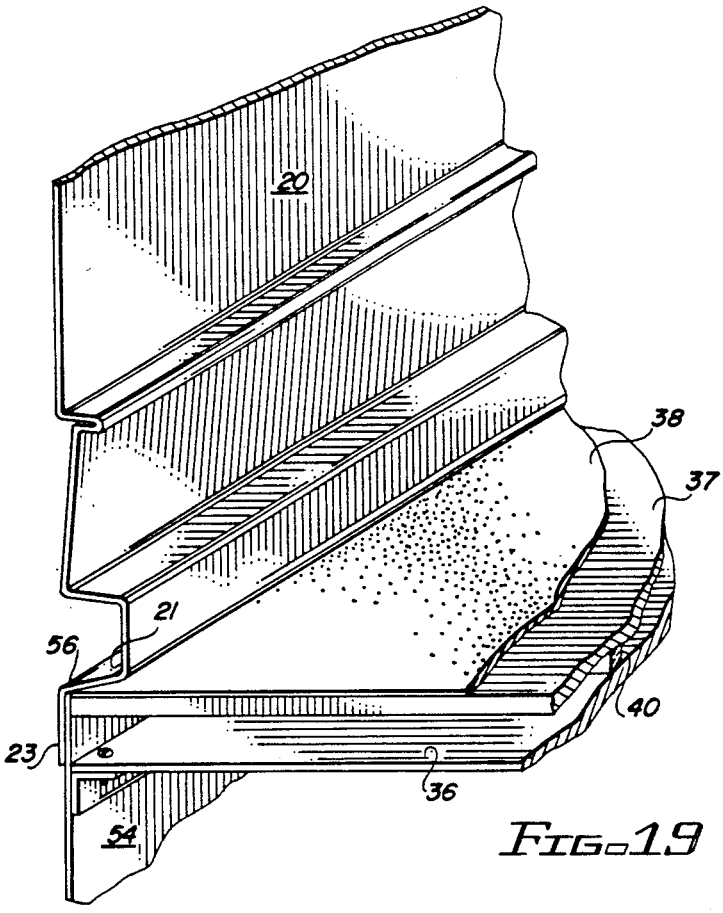
FIG. 19 is a perspective view, all partially broken away, illustrating the manner in which the superstructure, deck and hull are made into a unitary construction.

The manner in which the superstructure member 20 of the pontoon boat 10 is joined together in a unitary fashion with the deck 18 and the hull 16 will now be described with reference to FIGS. 17–19. As previously discussed, each of the superstructure members 20 comprise a unitary molded panel formed of a plastic resin such as fiberglass, for example. Preferably, each panel 20 is molded with a lower indentation 21 and a lower vertical portion 23. The vertical portion 23 thus forms a flange and the indentation 21 forms a abutment for joinder to the deck and to the hull, as illustrated in FIGS. 17–19 Suitably, the molded superstructure panel 20 is fastened to both the upper extremity 56 and the upper deck 37 with a fastener 64. Similarly, the lower deck 36 is bolted to the outer vertical panel 54 of the hull 16 with the lower deck 36 being rigidly joined with the upper deck 37 via the lateral struts 40. After the molded superstructure panel 20 is joined in the manner just described, then an outer fascia molding 70 may be joined with fastener 72 over the intersection of the panel 20, deck 37 and vertical extremity 56 to cover the fasteners and reduce the likelihood of water intrusion during boat operation. In this way, a unitary, rigidized construction is achieved using an aluminum (or other metal) hull, while employing a superstructure of fiberglass or another diverse resinous construction material.

Figure 20:
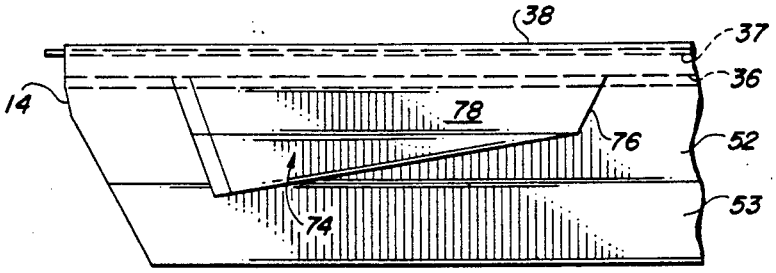
FIG. 20 is a cross-section of a portion of the pontoon boat shown in FIG. 3, illustrating the motor well.
Figure 21:
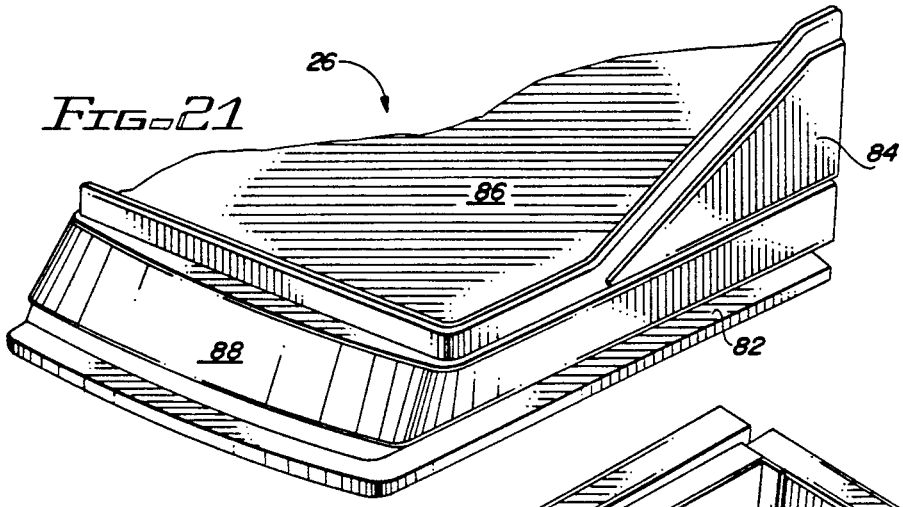
FIG. 21 is a perspective view illustrating one of the unitary superstructure members of a pontoon boat in accordance with the present invention.

Other construction details of the pontoon boat 10 are shown in FIGS. 20–22 and are described next.

Figure 3:
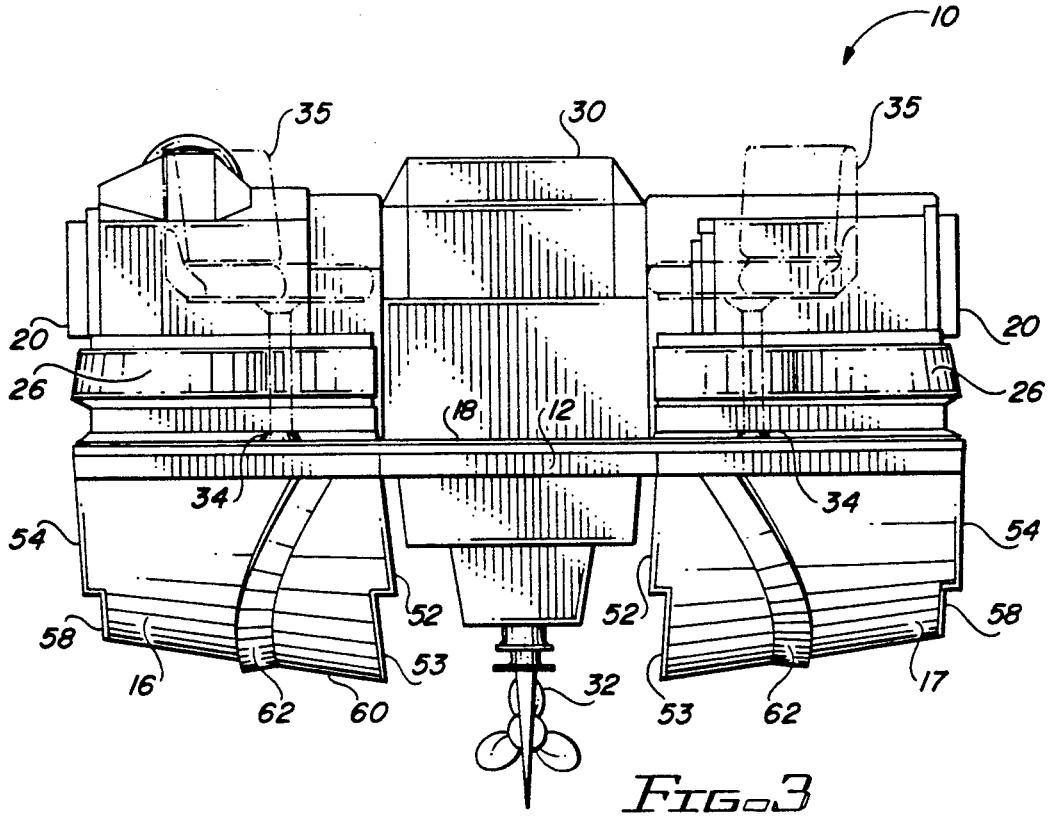
FIGS. 3 and 4 are front and rear elevations, respectively, of the embodiment of a pontoon boat shown in FIGS. 1 and 2.
Figure 4:
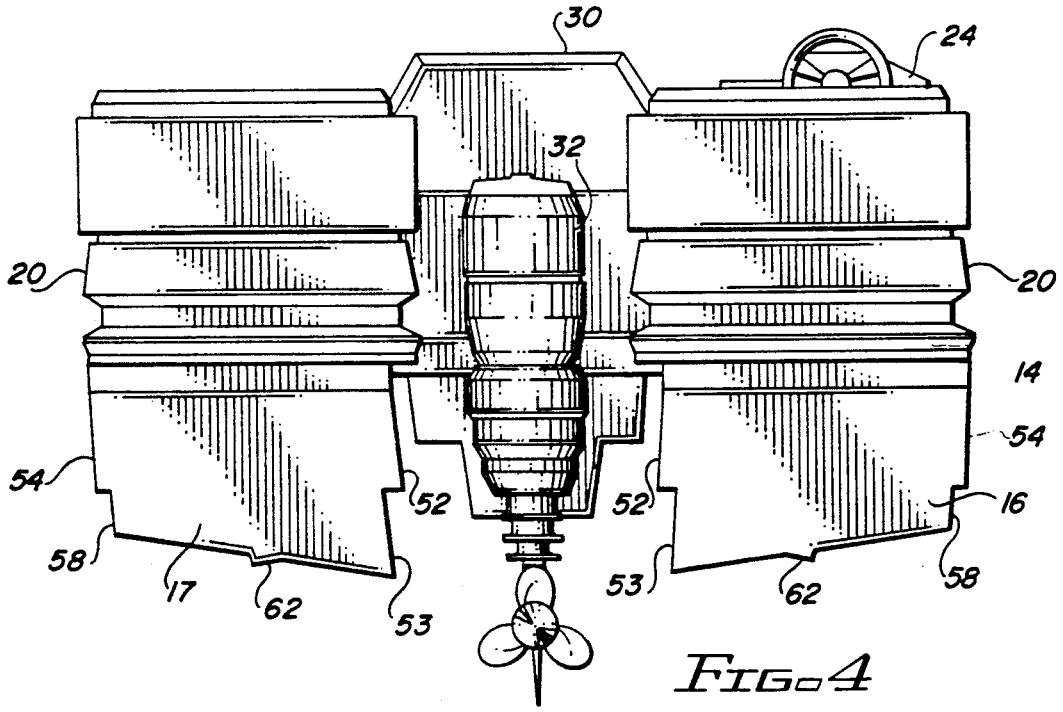

In FIG. 20, the motor well 74 is installed in the space between the two pontoons, such as pontoons 16 and 17 of FIGS. 3–5. Preferably, the motor well 74 is defined by a sidewall 78 which completely encloses the motor well, except at the rearward portion so that the lower unit of the motor may extend into the well. It is important that the forward extremity 76 of the motor well be closed to reduce frictional drag on the pontoon boat when under way. It will thus be appreciated by those skilled in the art that the lower deck 36 is free of any downwardly extending protrusions to provide structural support since the struts 40 are positioned between the lower deck 36 and the upper deck 37. The combination of the unobstructed lower surface of the deck 36 (i.e. without any downwardly extending protrusions) and the closed motor housing 74 significantly increases the efficiency of the pontoon boat when under way.

FIG. 21 illustrates one of the forward deck panels 26 of the pontoon boat shown in FIGS. 1 and 2. The forward deck panel 26 includes an indentation 82 molded therein about its periphery, to permit joinder to the deck and hull as described above with reference to FIGS. 17–19. The deck panel 26 also includes a vertical upstanding portion 84 which is molded in a unitary manner with a sloped rising surface 86 and a forward panel 88. While providing an extremely pleasing appearance, it will be appreciated by those skilled in the art that the formation of the deck member 26 as a unitary molded member avoids the vibration problems discussed above with prior art pontoon boats. Of course, such problems can be accentuated when the pontoon boat is operating at higher, planing speeds. However, those difficulties are avoided utilizing the unitary construction feature of the present invention.

FIG. 22 illustrates a cross-section of a portion of a pontoon 50 like that of FIGS. 6–16 and employing a longitudinal stringer 64. As discussed above, the buoyant flotation 94 is extended longitudinally along the vertical panels 52 and 54, and is held in place by metal panels 92 abutting the bulkheads 66.

While construction details of a pontoon boat in accordance with the present invention have been described above, it will be appreciated by those skilled in the art that various modifications may be made in those constructions without departing from the spirit and scope of the present invention.

What is claimed is:

1. A construction for a recreational pontoon boat, comprising:

a pair of pontoons formed of a thin gauge metal;

a deck across the pontoons;

a vertical superstructure formed of plural members, each superstructure member molded from a plastic resin into a unitary panel;

means for rigidly fastening each unitary molded panel to the metal pontoons and the deck to form a rigid construction; and wherein the pontoons include an upper extremity extending to the upper level of the deck and which upper extremity overlaps the outer periphery of the deck, and wherein each superstructure panel includes a longitudinal indentation defining a lower flange which abuts the upper extremity of the pontoons.

* * * * *